US010484115B2

(12) United States Patent
Iannuzzelli et al.

(10) Patent No.: US 10,484,115 B2
(45) Date of Patent: Nov. 19, 2019

(54) ANALOG AND DIGITAL AUDIO ALIGNMENT IN THE HD RADIO EXCITER ENGINE (EXGINE)

(71) Applicant: Ibiquity Digital Corporation, Columbia, MD (US)

(72) Inventors: Russell Iannuzzelli, Bethesda, MD (US); Adam Horowitz, Bridgewater, NJ (US); Jeffrey R Detweiler, Ellicott City, MD (US); William E. Snelling, Columbia, MD (US)

(73) Assignee: Ibiquity Digital Corporation, Columbia, MD (US)

( * ) Notice: Subject to any disclaimer, the term of this patent is extended or adjusted under 35 U.S.C. 154(b) by 0 days.

(21) Appl. No.: 16/108,355

(22) Filed: Aug. 22, 2018

(65) Prior Publication Data

US 2019/0253163 A1 Aug. 15, 2019

Related U.S. Application Data

(60) Provisional application No. 62/628,802, filed on Feb. 9, 2018.

(51) Int. Cl.
*H04H 20/18* (2008.01)
*H04H 20/95* (2008.01)
(Continued)

(52) U.S. Cl.
CPC ..... *H04H 20/18* (2013.01); *H04H 20/48* (2013.01); *H04H 20/95* (2013.01); *H04H 40/54* (2013.01);
(Continued)

(58) Field of Classification Search
CPC ..... H04H 20/18; H04H 20/48; H04H 20/95; H04H 40/54; H04H 2201/20;
(Continued)

(56) References Cited

U.S. PATENT DOCUMENTS 6,178,317 B1 1/2001 Kroeger et al.
6,473,604 B1 10/2002 Hinkle et al.
(Continued)

FOREIGN PATENT DOCUMENTS

WO WO-2017100528 A1 6/2017

OTHER PUBLICATIONS

"International Application Serial No. PCT/US2019/017338, International Search Report dated Apr. 30, 2019", 2 pgs.
(Continued)

*Primary Examiner* — Ted M Wang
(74) *Attorney, Agent, or Firm* — Schwegman Lundberg & Woessner, P.A.

(57) ABSTRACT

An apparatus comprises a digital input port configured to receive digital audio packets of main program service (MPS) audio; a modem operatively coupled to the digital port; an analog input port configured to receive an audio engineer society format (AES) audio signal that is a digitized version of the analog signal component of the frequency modulation (FM) hybrid radio signal; and an alignment unit configured to time-align the AES audio signal with the digital audio packets at the modem; wherein the modem is configured to generate the FM hybrid radio signal using the digital audio packets and the time-aligned AES audio signal.

20 Claims, 10 Drawing Sheets

(51) Int. Cl.
*H04H 20/48* (2008.01)
*H04H 40/54* (2008.01)

(52) U.S. Cl.
CPC ... *H04H 2201/183* (2013.01); *H04H 2201/20* (2013.01)

(58) Field of Classification Search
CPC ..... H04H 2201/183; H04L 27/2647; H04L 5/0007; H04L 27/2657; H04L 27/2662
See application file for complete search history.

(56) References Cited

U.S. PATENT DOCUMENTS

| | | | | |
|---|---|---|---|---|
| 6,590,944 | B1 | 7/2003 | Kroeger | |
| 6,735,257 | B2 | 5/2004 | Kroeger | |
| 6,901,242 | B2 | 5/2005 | Kroeger et al. | |
| 7,039,204 | B2 | 5/2006 | Baumgarte | |
| 7,546,088 | B2 | 6/2009 | Kroeger et al. | |
| 7,715,566 | B2 | 5/2010 | Seo | |
| 7,944,998 | B2 | 5/2011 | Shridhar et al. | |
| 7,953,183 | B2 | 5/2011 | Shridhar et al. | |
| 8,027,419 | B2 | 9/2011 | Iannuzzelli et al. | |
| 8,040,989 | B2 | 10/2011 | Nekhamkin et al. | |
| 8,165,548 | B2 | 4/2012 | Kon et al. | |
| 8,180,470 | B2 | 5/2012 | Pahuja | |
| 8,279,908 | B2 | 10/2012 | Iannuzzelli et al. | |
| 8,290,423 | B2 | 10/2012 | Wang et al. | |
| 8,451,868 | B2 | 5/2013 | Johnson et al. | |
| 8,520,852 | B2 | 8/2013 | Shah et al. | |
| 8,576,949 | B2 | 11/2013 | Shah et al. | |
| 8,615,095 | B2 | 12/2013 | Chen | |
| 8,804,865 | B2 | 8/2014 | Elenes et al. | |
| 8,976,969 | B2 | 3/2015 | Elenes et al. | |
| 9,025,773 | B2 | 5/2015 | Whitecar et al. | |
| 9,300,413 | B2 | 3/2016 | Jaisimha et al. | |
| 9,407,383 | B2 | 8/2016 | Milbar et al. | |
| 9,413,322 | B2 | 8/2016 | Soulodre et al. | |
| 9,559,657 | B2 | 1/2017 | Jaisimha et al. | |
| 9,584,347 | B2 | 2/2017 | Elenes | |
| 9,596,044 | B2 | 3/2017 | Nekhamkin | |
| 9,755,598 | B2 | 9/2017 | Olochwoszcz | |
| 9,876,592 | B2 | 1/2018 | Fuller et al. | |
| 9,947,332 | B2 | 4/2018 | Olochwoszcz et al. | |
| 10,117,020 | B2 * | 10/2018 | Mehta | H04R 29/004 |
| 10,255,926 | B2 | 4/2019 | Olochwoszcz et al. | |
| 2004/0076188 | A1 | 4/2004 | Milbar et al. | |
| 2006/0019601 | A1 * | 1/2006 | Kroeger | H04H 20/30 455/3.06 |
| 2006/0227814 | A1 | 10/2006 | Iannuzzelli et al. | |
| 2007/0291876 | A1 | 12/2007 | Shridhar et al. | |
| 2007/0293167 | A1 | 12/2007 | Shridhar et al. | |
| 2009/0061763 | A1 | 3/2009 | Dillon et al. | |
| 2009/0121740 | A1 | 5/2009 | Hauke | |
| 2010/0027719 | A1 | 2/2010 | Pahuja | |
| 2010/0166042 | A1 | 7/2010 | Iannuzzelli et al. | |
| 2011/0090897 | A1 | 4/2011 | Johnson et al. | |
| 2011/0110464 | A1 | 5/2011 | Watanabe | |
| 2012/0028567 | A1 | 2/2012 | Marko | |
| 2013/0003637 | A1 | 1/2013 | Elenes et al. | |
| 2013/0003894 | A1 | 1/2013 | Elenes et al. | |
| 2013/0003904 | A1 | 1/2013 | Elenes et al. | |
| 2013/0343547 | A1 | 12/2013 | Pahuja et al. | |
| 2014/0140537 | A1 | 5/2014 | Soulodre | |
| 2016/0182171 | A1 | 6/2016 | Milbar et al. | |
| 2016/0241350 | A1 | 8/2016 | Nekhamkin et al. | |
| 2016/0302093 | A1 | 10/2016 | Fuller et al. | |
| 2017/0169832 | A1 | 6/2017 | Olochwoszcz et al. | |
| 2017/0179899 | A1 | 6/2017 | Olochwoszcz et al. | |
| 2017/0302432 | A1 | 10/2017 | Kroeger et al. | |
| 2018/0308499 | A1 | 10/2018 | Olochwoszcz et al. | |

OTHER PUBLICATIONS

"International Application Serial No. PCT/US2019/017338, Written Opinion dated Apr. 30, 2019", 6 pgs.
"Algorithms to measure audio programme loudness and true-peak audio level", Recommendation ITU-R BS.1770-3, (2012), 1-22.
"U.S. Appl. No. 14/966,716, Examiner Interview Summary dated Nov. 14, 2017", 3 pgs.
"U.S. Appl. No. 14/966,716, Non Final Office Action dated Sep. 8, 2017", 8 pgs.
"U.S. Appl. No. 14/966,716, Notice of Allowance dated Dec. 13, 2017", 8 pgs.
"U.S. Appl. No. 14/966,716, Response filed Nov. 9, 2017 to Non Final Office Action dated Sep. 8, 2017", 9 pgs.
"U.S. Appl. No. 14/974,809, Non Final Office Action dated Feb. 7, 2017", 10 pgs.
"U.S. Appl. No. 14/974,809, Notice of Allowance dated May 3, 2017", 8 pgs.
"U.S. Appl. No. 14/974,809, Response filed Apr. 19, 2017 to Non Final Office Action dated Feb. 7, 2017", 7 pgs.
"U.S. Appl. No. 15/926,536, Non Final Office Action dated Aug. 9, 2018", 10 pgs.
"In-Band/On-Channel Digital Radio Broadcasting Standard", NRSC-5-C, National Radio Systems Committee, Washington, DC,, (Sep. 2011), 6 pgs.
"International Application Serial No. PCT/US2016/065754, International Preliminary Report on Patentability dated Jun. 21, 2018", 10 pgs.
"International Application Serial No. PCT/US2016/065754, International Search Report dated Mar. 10, 2017", 4 pgs.
"International Application Serial No. PCT/US2016/065754, Written Opinion dated Mar. 10, 2017", 10 pgs.
Soulodre, Gilbert A, et al., "Development and Evaluation of Short-Term Loudness Meters", Audio Engineering Society Convention Paper 6889, Presented at the 121st Convention, San Francisco, California, (Oct. 5-8, 2006), 1-10.
Soulodre, Gilbert A, "Evaluation of Objective Loudness Meters", Audio Engineering Society Convention Paper 6161, Presented at the 116th Convention, Berlin, Germany,, (May 8-11, 2004), 1-12.
"U.S. Appl. No. 15/926,536, Notice of Allowance dated Nov. 28, 2018", 8 pgs.
"U.S. Appl. No. 15/926,536, Response filed Oct. 17, 2018 to Non Final Office Action dated Aug. 9, 2018", 12 pgs.

* cited by examiner

ANALOG AND DIGITAL AUDIO ALIGNMENT IN THE HD RADIO EXCITER ENGINE (EXGINE)

CLAIM OF PRIORITY

This application claims the benefit of priority under 35 U.S.C. § 119(e) of U.S. Provisional Patent Application Ser. No. 62/628,802, filed on Feb. 9, 2018, which is herein incorporated by reference in its entirety.

TECHNICAL FIELD

This invention relates to methods, devices, and systems for digital radio broadcasting technology.

BACKGROUND

Digital radio broadcasting technology delivers digital audio and data services to mobile, portable, and fixed receivers. One type of digital radio broadcasting, referred to as in-band on-channel (IBOC) digital audio broadcasting (DAB), uses terrestrial transmitters in the existing Medium Frequency (MF) and Very High Frequency (VHF) radio bands. HD Radio™ technology, developed by iBiquity Digital Corporation, is one example of an IBOC implementation for digital radio broadcasting and reception. IBOC DAB signals can be transmitted in a hybrid format including an analog modulated carrier in combination with a plurality of digitally modulated carriers. Using the hybrid mode, broadcasters may continue to transmit analog AM and FM simultaneously with higher-quality and more robust digital signals, allowing themselves and their listeners to convert from analog-to-digital radio while maintaining their current frequency allocations.

The HD Radio system allows multiple services to share the broadcast capacity of a single station. One feature of digital transmission systems is the inherent ability to simultaneously transmit both digitized audio and data. Thus the technology also allows for wireless data services from AM and FM radio stations. First generation (core) services include a Main Program Service (MPS) and the Station Information Service (SIS). Second generation services, referred to as Advanced Application Services (AAS), include information services providing, for example, multicast programming, electronic program guides, navigation maps, traffic information, multimedia programming and other content. The AAS Framework provides a common infrastructure to support the developers of these services. The AAS Framework provides a platform for a large number of service providers and services for terrestrial radio. It has opened up numerous opportunities for a wide range of services (both audio and data) to be deployed through the system.

The National Radio Systems Committee, a standard-setting organization sponsored by the National Association of Broadcasters and the Consumer Electronics Association, adopted an IBOC standard, designated NRSC-5A, in September 2005. NRSC-5A, the disclosure of which is incorporated herein by reference, sets forth the requirements for broadcasting digital audio and ancillary data over AM and FM broadcast channels. The standard and its reference documents contain detailed explanations of the RF/transmission subsystem and the transport and service multiplex subsystems.

Depending on the loudspeaker look direction and the location of the listener, the directivity to the left ear and the right ear can be different. The difference can degrade the performance of spatial audio processing as well as timbre balance.

Alignment of analog and digital audio can be a problem in IBOC digital radio systems (such as the HD Radio system). For example, if the broadcast has not aligned the analog audio with the digital audio, then the listening experience can be negative. There are several reasons for misalignment in the broadcast equipment.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The technology presented relates to broadcasting of frequency modulation (FM) in-band on-channel (IBOC) radio signals. FM IBOC radio signals include both analog and digital audio information to be processed by an HD radio receiver. As explained above, if the analog audio in the broadcast signal is not aligned with the digital audio in the broadcast signal, the experience at the radio receiver can be very negative for the user.

In general, embodiments of the invention put the alignment feature into a core piece of equipment that is controlled by the owners of HD Radio. In particular, the alignment feature resides in the exciter engine (also known as the "exgine"). The exgine is in a prime location to perform the alignment because the exgine contains the decoded digital as the audio source for digital and an AES sampled source for analog.

In addition, if the clocks between the exporter and the exgine are not synchronized, then embodiments of the invention allow for rate lock at the exgine by using the digital and analog audio sample count as a measure of the desynchronization. In many broadcast geometries embodiments of the invention will solve the alignment problem.

The solutions offered by embodiments of the invention are unique because they make use of the decoded digital as the source for digital and the AES sampled analog as the source for analog. Another unique feature of embodiments of the invention include mitigating the use of the rate by using the difference in sample count to adjust the core clock at the exgine.

Embodiments of the invention offer the advantage of an alignment feature contained in a core piece of HD Radio equipment that is necessary for all HD Radio installations.

An apparatus example includes a digital input port configured to receive digital audio packets of main program service (MPS) audio, a modem operatively coupled to the digital port, an analog input port configured to receive an audio engineer society format (AES) audio signal that is a digitized version of the analog signal component of the frequency modulation (FM) hybrid radio signal, and an alignment unit configured to time-align the AES audio signal with the digital audio packets at the modem. The modem is configured to generate the FM hybrid radio signal using the digital audio packets and the time-aligned AES audio signal.

A method example includes: receiving digital audio packets of main program service (MPS) audio at a digital port of the hybrid radio exciter engine and providing the digital audio packets to a modem of the hybrid radio exciter engine; receiving an audio engineer society format (AES) audio signal of the MPS audio at an analog port of the hybrid radio exciter engine, wherein the AES audio signal is a digitized version of an analog audio signal of the MPS audio; aligning the AES audio signal in time with corresponding digital audio packets at the modem; and generating a frequency modulated (FM) hybrid radio signal for broadcast that includes time-aligned analog MPS audio and digital MPS audio.

An apparatus example includes a digital input port configured to receive digital audio packets of main program service (MPS) audio, a modem operatively coupled to the digital port; an analog input port configured to receive AES audio signal that is a digitized version of the analog signal component of an FM hybrid radio signal, a sampling circuit configured to resample the AES audio signal to produce a clock-restored AES audio signal, and a rate adjustment circuit configured to determine a sampling rate of digital audio information included in the digital audio packets and adjust a rate of resampling of the AES audio signal to reduce a sample rate difference between an audio sample of the clock-restored AES audio signal and a digital audio packet corresponding to the audio sample. The modem generates the FM hybrid radio signal using time-aligned AES audio samples and digital MPS audio.

It should be noted that alternative embodiments are possible, and steps and elements discussed herein may be changed, added, or eliminated, depending on the particular embodiment. These alternative embodiments include alternative steps and alternative elements that may be used, and structural changes that may be made, without departing from the scope of the invention.

DETAILED DESCRIPTION

Figure 1:
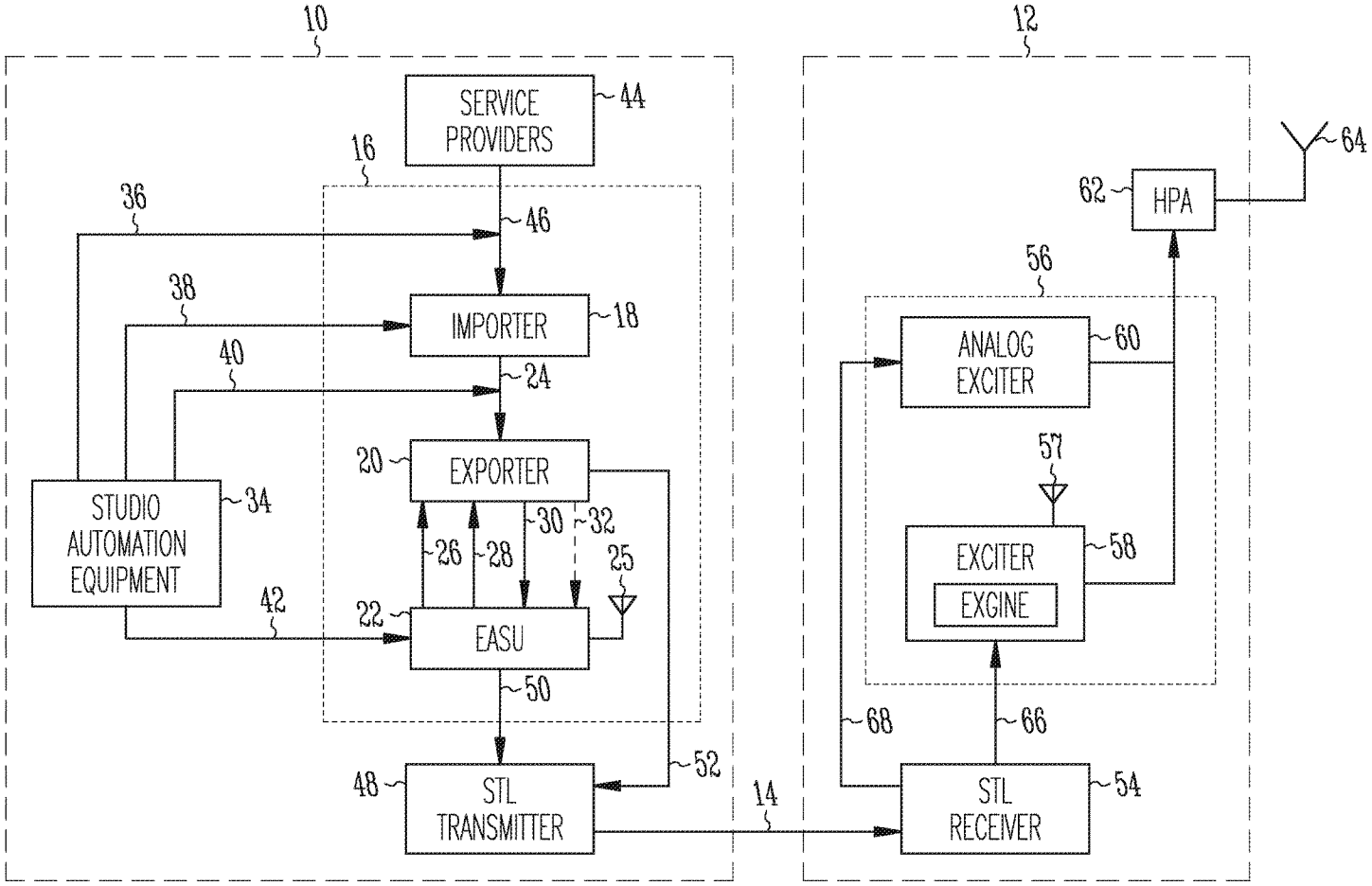
FIG. 1 is a block diagram of a transmitter for use in an in-band on-channel (IBOC) digital radio broadcasting system.

The following description describes various embodiments of methods, devices and systems that provide improved broadcasting of IBOC radio signals. FIG. 1 is a functional block diagram of a portion of the components of a studio site 10, an FM transmitter site 12, and a studio transmitter link (STL) 14 that can be used to broadcast an FM IBOC DAB signal. The studio site includes, among other things, studio automation equipment 34, an Ensemble Operations Center (EOC) 16 that includes an importer 18, an exporter 20, an exciter auxiliary service unit (EASU) 22, and an STL transmitter 48. The transmitter site includes an STL receiver 54, a digital exciter 56 that includes an exciter engine (exgine) subsystem 58, and an analog exciter 60. While in FIG. 1 the exporter is resident at a radio station's studio site and the exciter is located at the transmission site, these elements may be co-located at the transmission site.

At the studio site, the studio automation equipment supplies main program service (MPS) audio 42 to the EASU, MPS data 40 to the exporter, supplemental program service (SPS) audio 38 to the importer, and SPS data 36 to the importer. MPS audio serves as the main audio programming source. In hybrid modes, it preserves the existing analog radio programming formats in both the analog and digital transmissions. MPS data, also known as program service data (PSD), includes information such as music title, artist, album name, etc. Supplemental program service can include supplementary audio content as well as program associated data.

The importer contains hardware and software for supplying advanced application services (AAS). A "service" is content that is delivered to users via an IBOC DAB broadcast, and AAS can include any type of data that is not classified as MPS, SPS, or Station Information Service (SIS). SIS provides station information, such as call sign, absolute time, position correlated to GPS, etc. Examples of AAS data include real-time traffic and weather information, navigation map updates or other images, electronic program guides, multimedia programming, other audio services, and other content. The content for AAS can be supplied by service providers 44, which provide service data 46 to the importer via an application program interface (API). The service providers may be a broadcaster located at the studio site or externally sourced third-party providers of services and content. The importer can establish session connections between multiple service providers. The importer encodes and multiplexes service data 46, SPS audio 38, and SPS data 36 to produce exporter link data 24, which is output to the exporter via a data link.

The exporter 20 contains the hardware and software necessary to supply the main program service and SIS for broadcasting. The exporter accepts digital MPS audio 26 over an audio interface and compresses the audio. The exporter also multiplexes MPS data 40, exporter link data 24, and the compressed digital MPS audio to produce exciter link data 52. In addition, the exporter accepts analog MPS audio 28 over its audio interface and applies a pre-programmed delay to it to produce a delayed analog MPS audio signal 30. This analog audio can be broadcast as a backup channel for hybrid IBOC DAB broadcasts. The delay compensates for the system delay of the digital MPS audio, allowing receivers to blend between the digital and analog program without a shift in time. In an AM transmission system, the delayed MPS audio signal 30 is converted by the exporter to a mono signal and sent directly to the STL as part of the exciter link data 52.

The EASU 22 accepts MPS audio 42 from the studio automation equipment, rate converts it to the proper system clock, and outputs two copies of the signal, one digital (26) and one analog (28). The EASU includes a GPS receiver that is connected to an antenna 25. The GPS receiver allows the EASU to derive a master clock signal, which is synchronized to the exciter's clock by use of GPS units. The EASU provides the master system clock used by the exporter. The EASU is also used to bypass (or redirect) the analog MPS audio from being passed through the exporter in the event the exporter has a catastrophic fault and is no longer operational. The bypassed audio 32 can be fed directly into the STL transmitter, eliminating a dead-air event.

STL transmitter 48 receives delayed analog MPS audio 50 and exciter link data 52. It outputs exciter link data and delayed analog MPS audio over STL link 14, which may be either unidirectional or bidirectional. The STL link may be a digital microwave or Ethernet link, for example, and may use the standard User Datagram Protocol or the standard TCP/IP.

The transmitter site includes an STL receiver 54, an exciter 56 and an analog exciter 60. The STL receiver 54 receives exciter link data, including audio and data signals as well as command and control messages, over the STL link 14. The exciter link data is passed to the exciter 56, which produces the IBOC DAB waveform. The exciter includes a host processor, digital up-converter, RF up-converter, and exgine subsystem 58. The exgine accepts exciter link data and modulates the digital portion of the IBOC DAB waveform. The digital up-converter of exciter 56 converts from digital-to-analog the baseband portion of the exgine output. The digital-to-analog conversion is based on a GPS clock, common to that of the exporter's GPS-based clock derived from the EASU. Thus, the exciter 56 can include a GPS unit and antenna 57.

Figure 2:
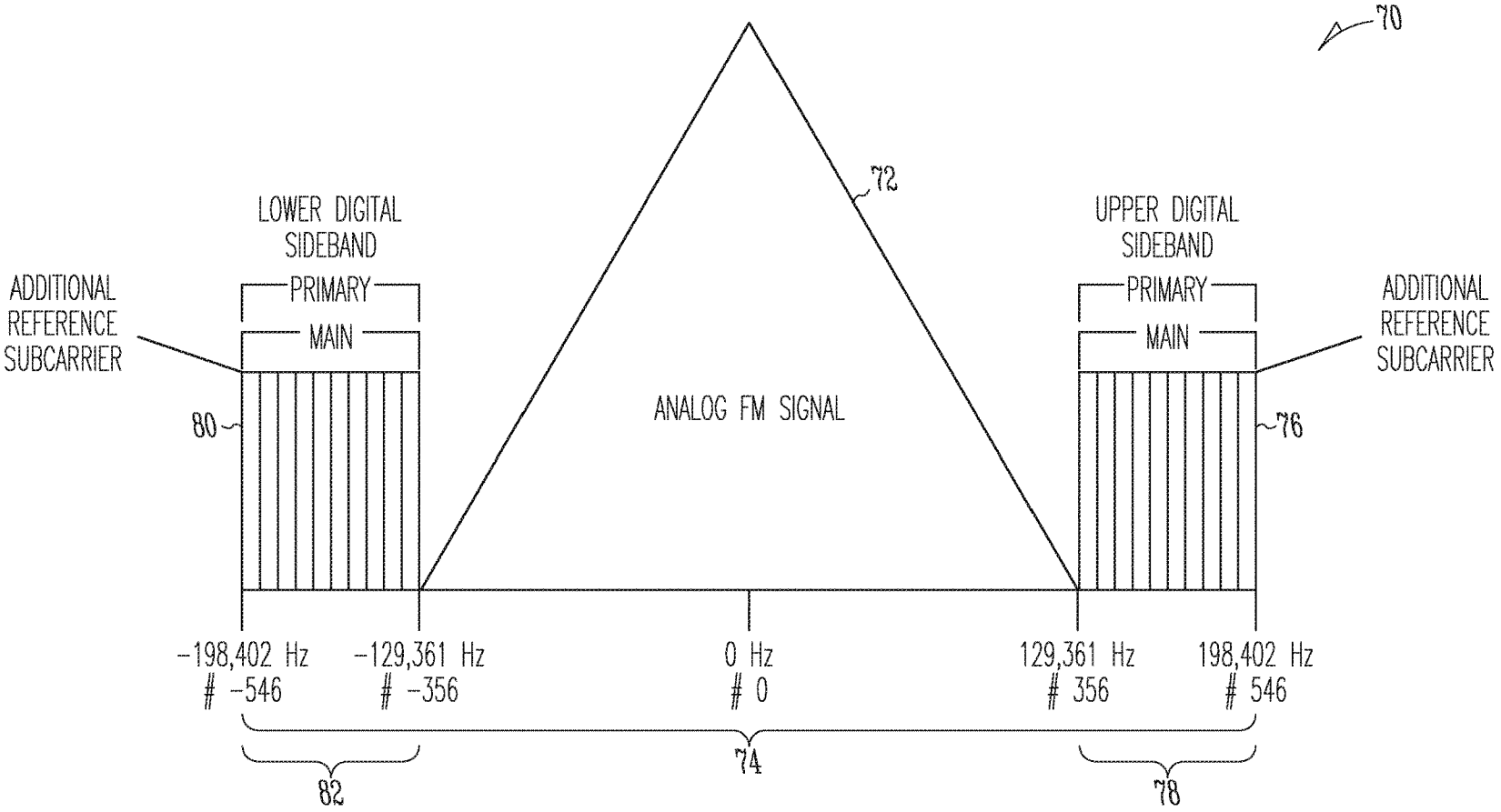
FIG. 2 is a schematic representation of a hybrid FM IBOC waveform.

FIG. 2 is a schematic representation of a hybrid FM IBOC waveform 70. The waveform includes an analog modulated signal 72 located in the center of a broadcast channel 74, a first plurality of evenly spaced orthogonally frequency division multiplexed subcarriers 76 in an upper sideband 78, and a second plurality of evenly spaced orthogonally frequency division multiplexed subcarriers 80 in a lower sideband 82. The digitally modulated subcarriers are divided into partitions and various subcarriers are designated as reference subcarriers. A frequency partition is a group of 19 OFDM subcarriers containing 18 data subcarriers and one reference subcarrier.

The hybrid waveform includes an analog FM signal, plus digitally modulated primary main subcarriers. The subcarriers are located at evenly spaced frequency locations. The subcarrier locations are numbered from −546 to +546. In the waveform of FIG. 2, the subcarriers are at locations +356 to +546 and −356 to −546. Each primary main sideband is comprised often frequency partitions. Subcarriers 546 and −546, also included in the primary main sidebands, are additional reference subcarriers. The amplitude of each subcarrier can be scaled by an amplitude scale factor.

Figure 3:
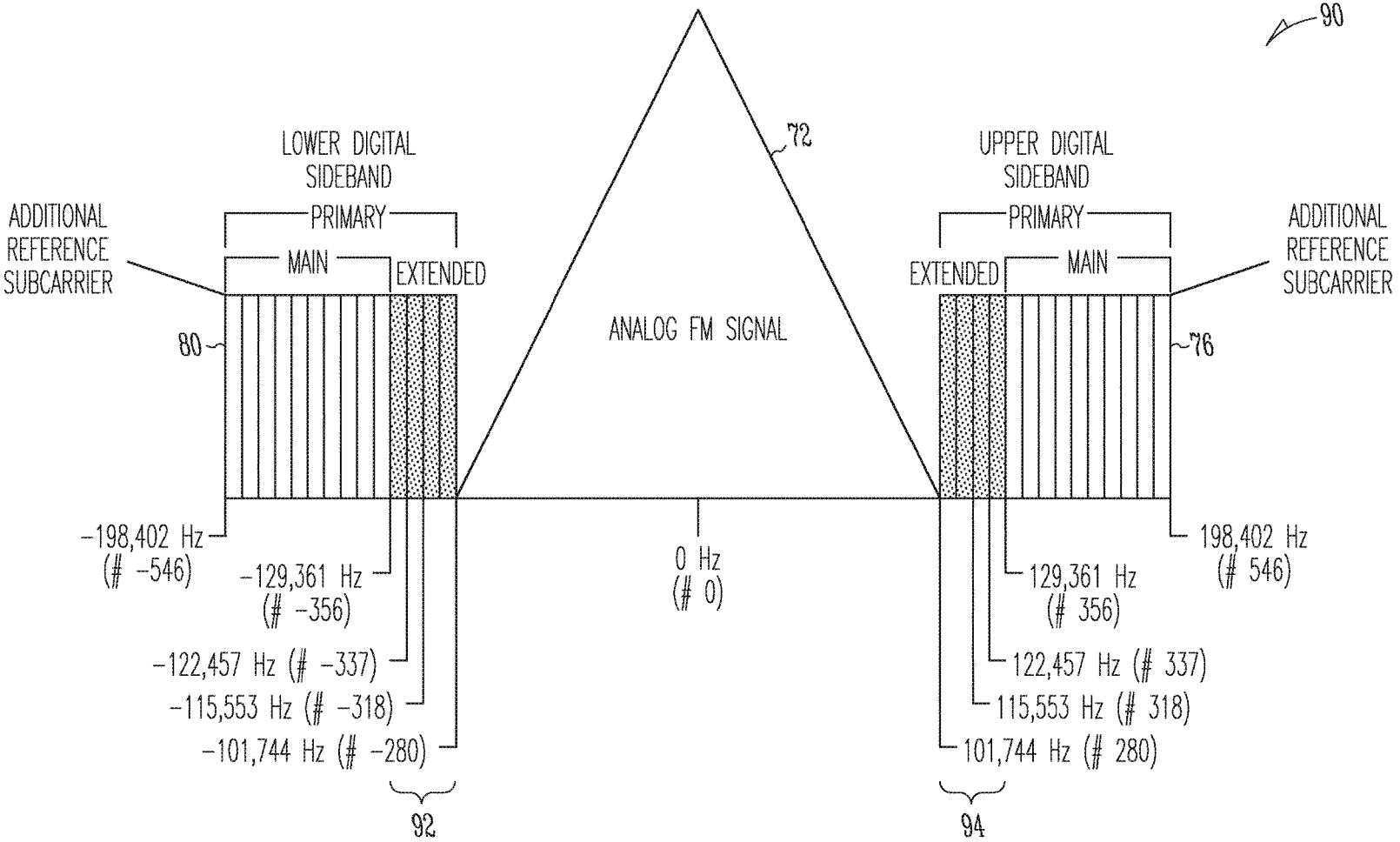
FIG. 3 is a schematic representation of an extended hybrid FM IBOC waveform.

FIG. 3 is a schematic representation of an extended hybrid FM IBOC waveform 90. The extended hybrid waveform is created by adding primary extended sidebands 92, 94 to the primary main sidebands present in the hybrid waveform. One, two, or four frequency partitions can be added to the inner edge of each primary main sideband. The extended hybrid waveform includes the analog FM signal plus digitally modulated primary main subcarriers (subcarriers +356 to +546 and −356 to −546) and some or all primary extended subcarriers (subcarriers +280 to +355 and −280 to −355).

The upper primary extended sidebands include subcarriers 337 through 355 (one frequency partition), 318 through 355 (two frequency partitions), or 280 through 355 (four frequency partitions). The lower primary extended sidebands include subcarriers −337 through −355 (one frequency partition), −318 through −355 (two frequency partitions), or −280 through −355 (four frequency partitions). The amplitude of each subcarrier can be scaled by an amplitude scale factor.

In each of the hybrid and extended hybrid waveforms, the digital signal is modulated using orthogonal frequency division multiplexing (OFDM). OFDM is a parallel modulation scheme in which the data stream modulates a large number of orthogonal subcarriers, which are transmitted simultaneously. OFDM is inherently flexible, readily allowing the mapping of logical channels to different groups of subcarriers.

In the hybrid waveform, the digital signal is transmitted in primary main (PM) sidebands on either side of the analog FM signal in the hybrid waveform. The power level of each sideband is appreciably below the total power in the analog FM signal. The analog signal may be monophonic or stereo, and may include subsidiary communications authorization (SCA) channels.

In the extended hybrid waveform, the bandwidth of the hybrid sidebands can be extended toward the analog FM signal to increase digital capacity. This additional spectrum, allocated to the inner edge of each primary main sideband, is termed the primary extended (PX) sideband.

Figure 4:
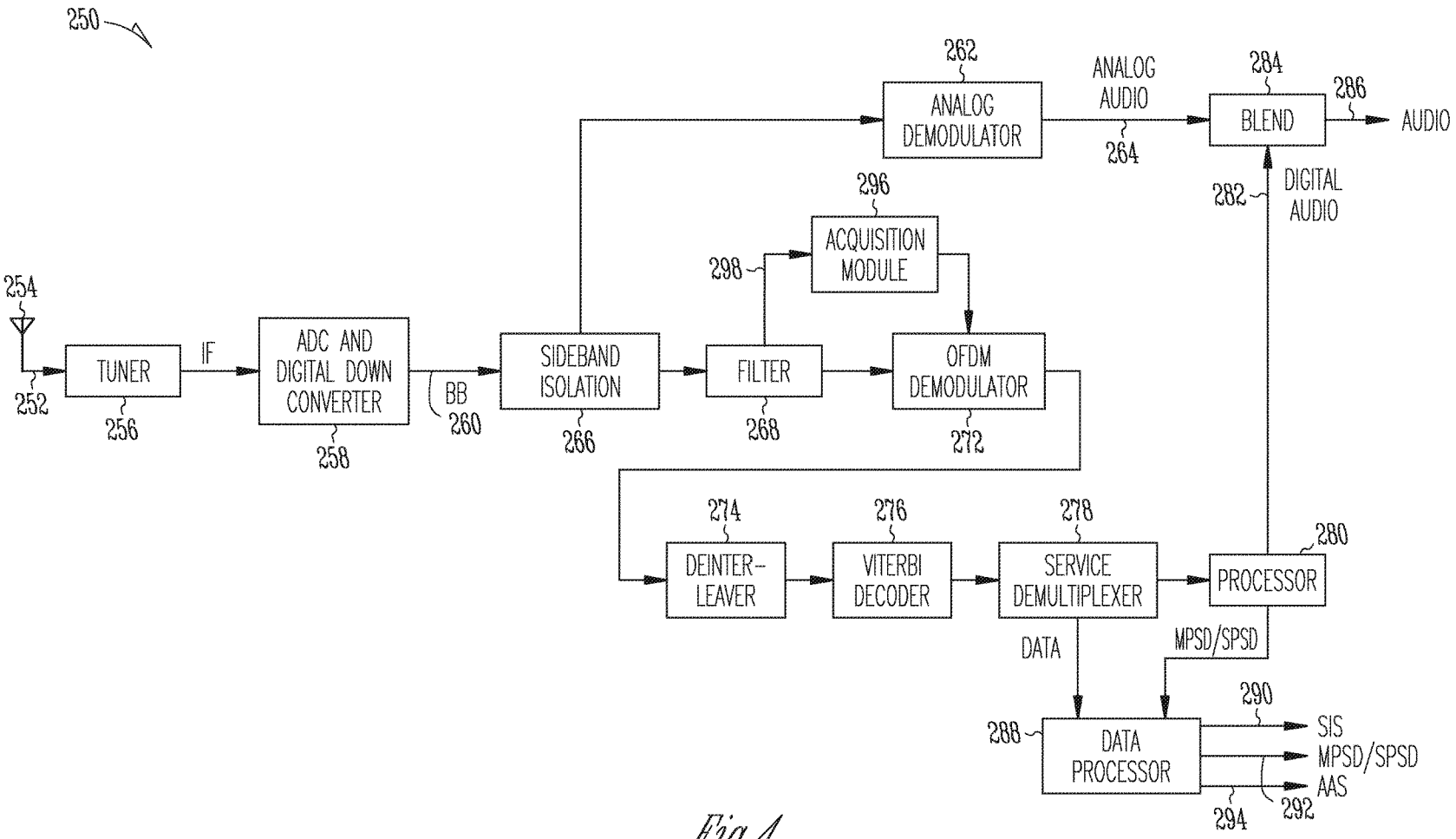
FIG. 4 is a simplified functional block diagram of an FM IBOC radio receiver.

FIG. 4 is a simplified functional block diagram of an FM IBOC DAB receiver 250. The receiver includes an input 252 connected to an antenna 254 and a tuner or front end 256. A received signal is provided to an analog-to-digital converter and digital down converter 258 to produce a baseband signal at output 260 comprising a series of complex signal samples. The signal samples are complex in that each sample comprises a "real" component and an "imaginary" component, which is sampled in quadrature to the real component. An analog demodulator 262 demodulates the analog modulated portion of the baseband signal to produce an analog audio signal on line 264. The digitally modulated portion of the sampled baseband signal is next filtered by sideband isolation filter 266, which has a pass-band frequency response comprising the collective set of subcarriers $f_1$-$f_n$ present in the received OFDM signal. Filter 268 suppresses the effects of a first-adjacent interferer. Complex signal 298 is routed to the input of acquisition module 296, which acquires or recovers OFDM symbol timing offset or error and carrier frequency offset or error from the received OFDM symbols as represented in received complex signal 298. Acquisition module 296 develops a symbol timing offset $\Delta t$ and carrier frequency offset $\Delta f$, as well as status and control information. The signal is then demodulated (block 272) to demodulate the digitally modulated portion of the baseband signal. Then the digital signal is deinterleaved by a deinterleaver 274, and decoded by a Viterbi decoder 276. A service demultiplexer 278 separates main and supplemental program signals from data signals. A processor 280 processes the main and supplemental program signals to produce a digital audio signal on line 282. The analog and main digital audio signals are blended as shown in block 284, or the supplemental program signal is passed through, to produce an audio output on line 286. A data processor 288 processes the data signals and produces data output signals on lines 290, 292 and 294. The data signals can include, for example, a station information service (SIS), main program service data (MPSD), supplemental program service data (SPSD), and one or more advanced application services (AAS). In practice, many of the signal processing functions shown in the receiver of FIG. 4 can be implemented using one or more integrated circuits.

Figure 5A:
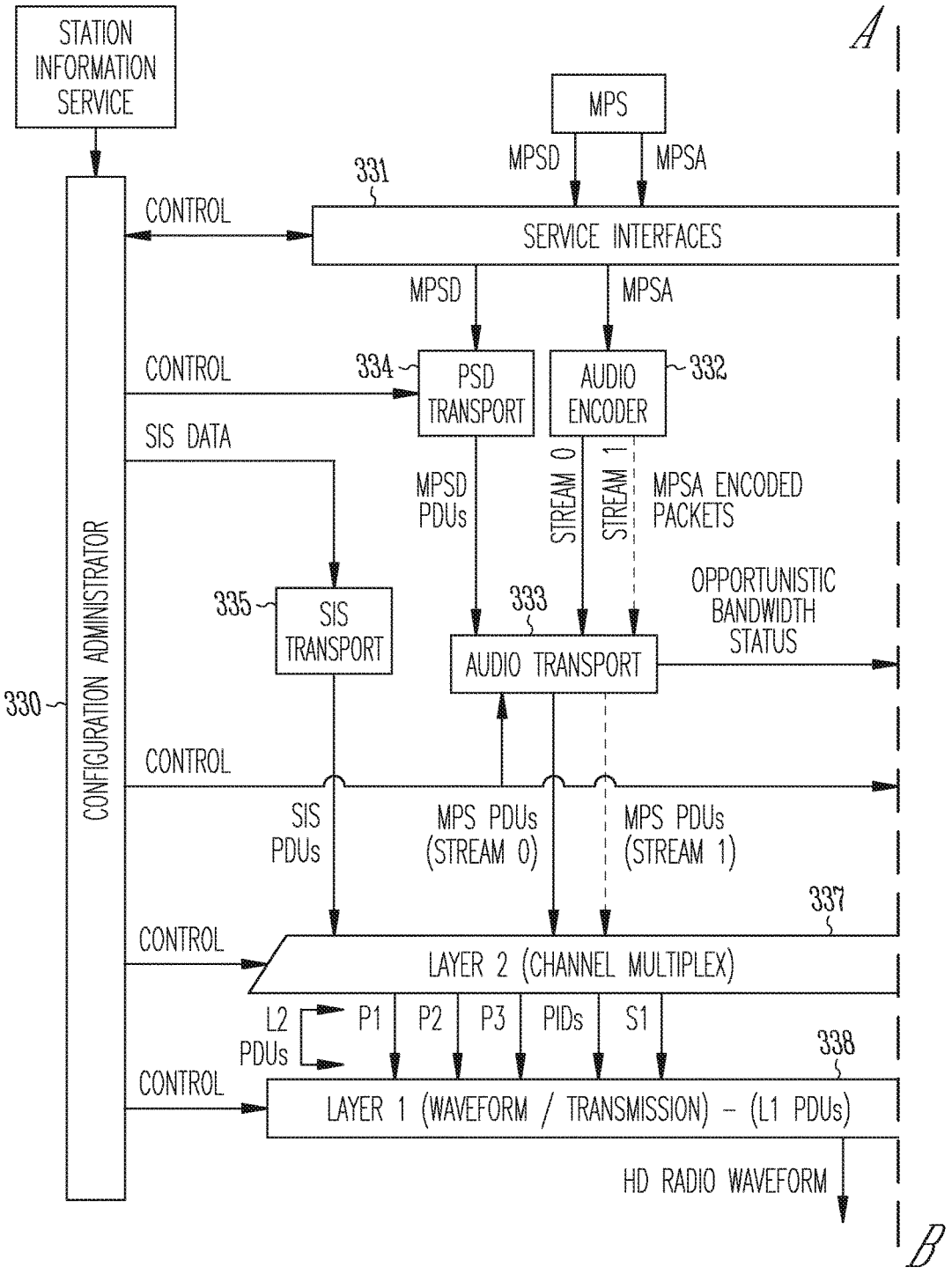
FIGS. 5A and 5B are diagrams of an IBOC radio logical protocol stack from the broadcast perspective.
Figure 5B:
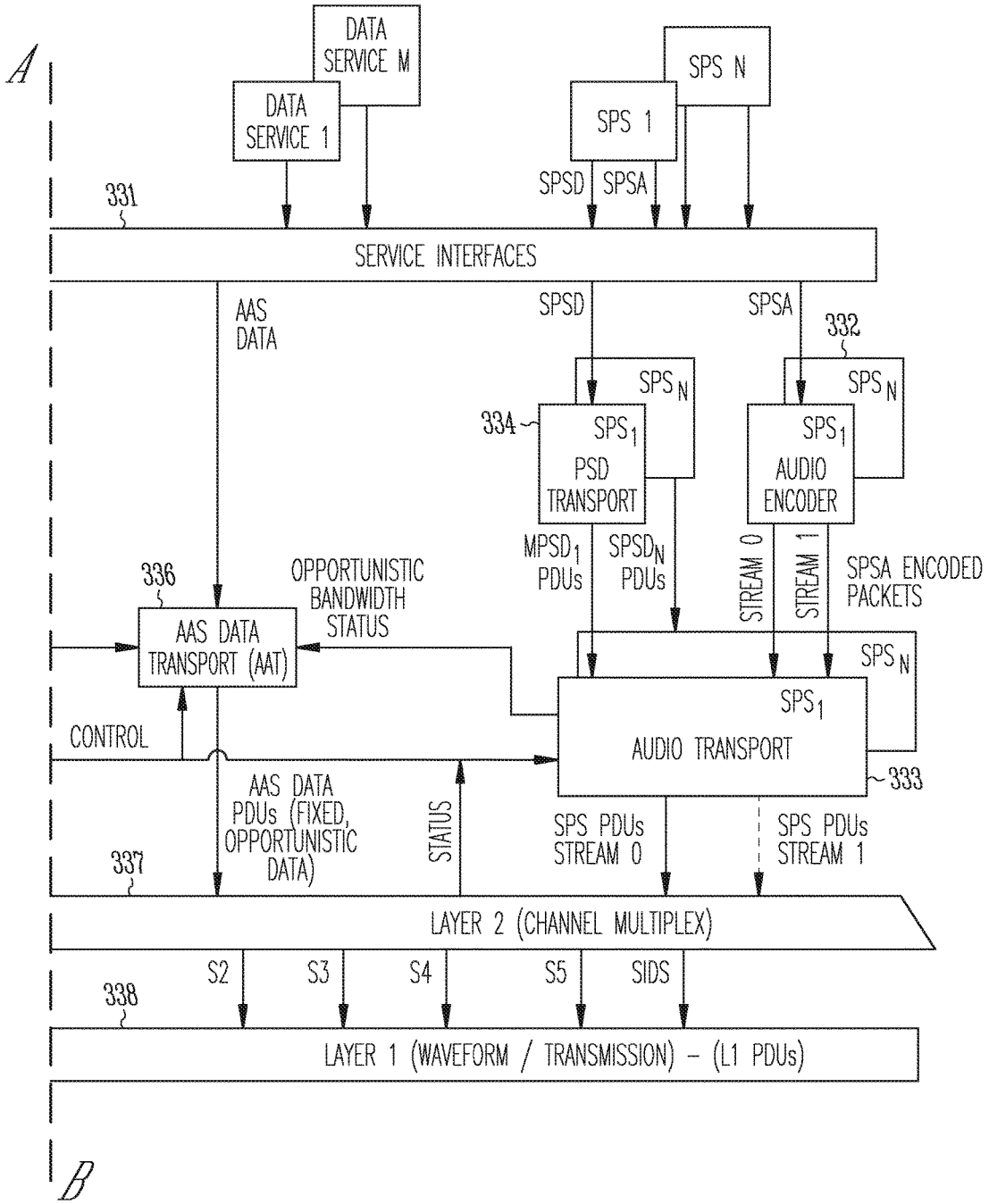

FIGS. 5A and 5B are diagrams of an IBOC DAB logical protocol stack from the transmitter perspective. From the receiver perspective, the logical stack will be traversed in the opposite direction. Most of the data being passed between the various entities within the protocol stack are in the form of protocol data units (PDUs). A PDU is a structured data block that is produced by a specific layer (or process within a layer) of the protocol stack. The PDUs of a given layer may encapsulate PDUs from the next higher layer of the stack and/or include content data and protocol control information originating in the layer (or process) itself. The PDUs generated by each layer (or process) in the transmitter protocol stack are inputs to a corresponding layer (or process) in the receiver protocol stack.

As shown in FIGS. 5A and 5B, there is a configuration administrator 330, which is a system function that supplies configuration and control information to the various entities within the protocol stack. The configuration/control information can include user defined settings, as well as information generated from within the system such as GPS time and position. The service interfaces 331 represent the interfaces for all services except SIS. The service interface may be different for each of the various types of services. For example, for MPS audio and SPS audio, the service interface may be an audio card. For MPS data and SPS data the interfaces may be in the form of different application program interfaces (APIs). For all other data services the interface is in the form of a single API. An audio codec 332 encodes both MPS audio and SPS audio to produce core (Stream 0) and optional enhancement (Stream 1) streams of MPS and SPS audio encoded packets, which are passed to audio transport 333. Audio codec 332 also relays unused capacity status to other parts of the system, thus allowing the inclusion of opportunistic data. MPS and SPS data is processed by program service data (PSD) transport 334 to produce MPS and SPS data PDUs, which are passed to audio transport 333. Audio transport 333 receives encoded audio packets and PSD PDUs and outputs bit streams containing both compressed audio and program service data. The SIS transport 335 receives SIS data from the configuration administrator and generates SIS PDUs. A SIS PDU can contain station identification and location information, program type, as well as absolute time and position correlated to GPS. The AAS data transport 336 receives AAS data from the service interface, as well as opportunistic bandwidth data from the audio transport, and generates AAS data PDUs, which can be based on quality of service parameters. The transport and encoding functions are collectively referred to as Layer 4 of the protocol stack and the corresponding transport PDUs are referred to as Layer 4 PDUs or L4 PDUs. Layer 2, which is the channel multiplex layer, (337) receives transport PDUs from the SIS transport, AAS data transport, and audio transport, and formats them into Layer 2 PDUs. A Layer 2 PDU includes protocol control information and a payload, which can be audio, data, or a combination of audio and data. Layer 2 PDUs are routed through the correct logical channels to Layer 1 (338), wherein a logical channel is a signal path that conducts L1 PDUs through Layer 1 with a specified grade of service. There are multiple Layer 1 logical channels based on service mode, wherein a service mode is a specific configuration of operating parameters specifying throughput, performance level, and selected logical channels. The number of active Layer 1 logical channels and the characteristics defining them vary for each service mode. Status information is also passed between Layer 2 and Layer 1. Layer 1 converts the PDUs from Layer 2 and system control information into an AM or FM IBOC DAB waveform for transmission. Layer 1 processing can include scrambling, channel encoding, interleaving, OFDM subcarrier mapping, and OFDM signal generation. The output of OFDM signal generation is a complex, baseband, time domain pulse representing the digital portion of an IBOC signal for a particular symbol. Discrete symbols are concatenated to form a continuous time domain waveform, which is modulated to create an IBOC waveform for transmission.

Figure 6:
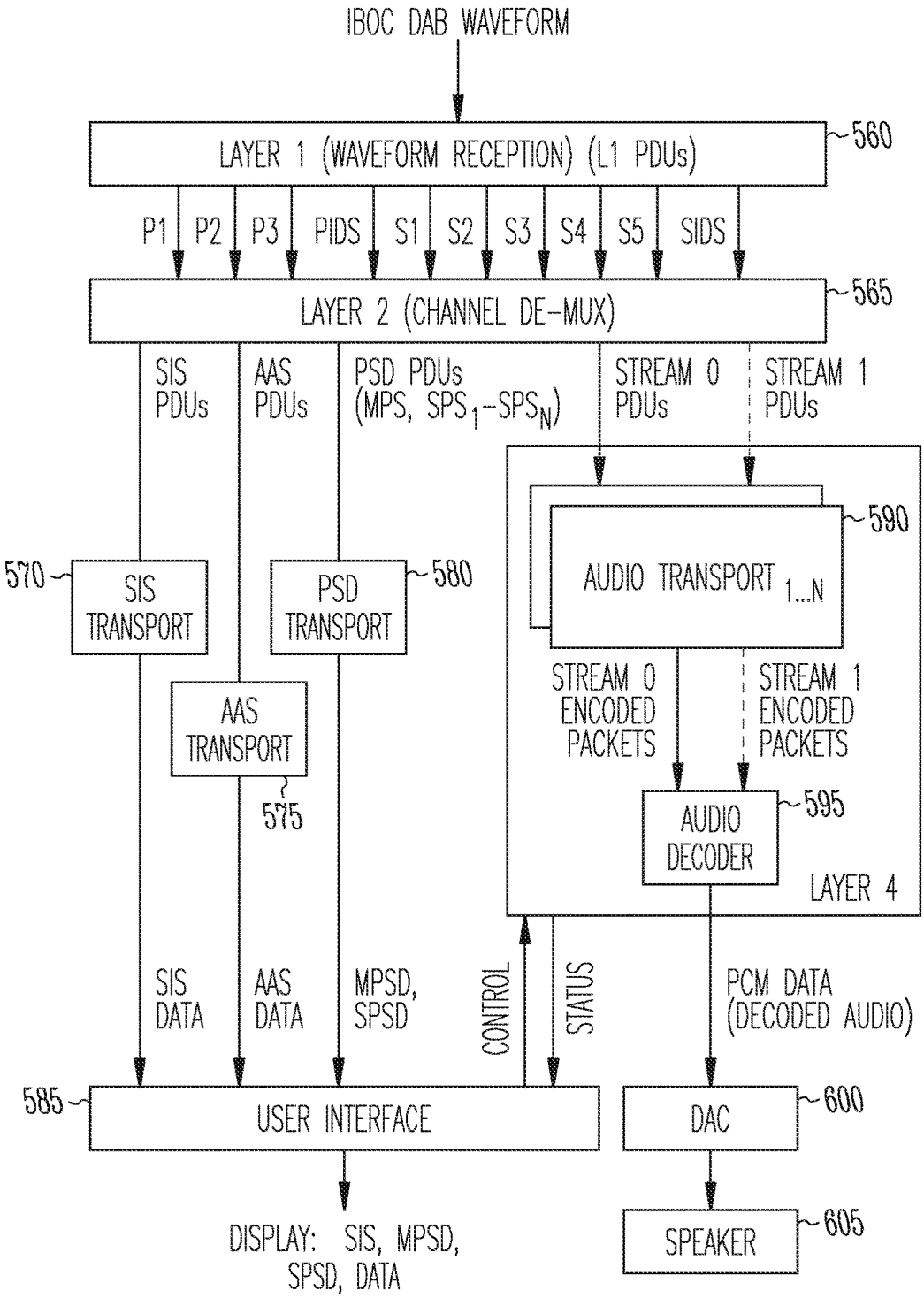
FIG. 6 is a diagram of an IBOC radio logical protocol stack from the receiver perspective.

FIG. 6 shows the logical protocol stack from the receiver perspective. An IBOC waveform is received by the physical layer, Layer 1 (560), which demodulates the signal and processes it to separate the signal into logical channels. The number and kind of logical channels will depend on the service mode, and may include logical channels P1-P3, PIDS, S1-S5, and SIDS. Layer 1 produces L1 PDUs corresponding to the logical channels and sends the PDUs to Layer 2 (565), which demultiplexes the L1 PDUs to produce SIS PDUs, AAS PDUs, PSD PDUs for the main program service and any supplemental program services, and Stream 0 (core) audio PDUs and Stream 1 (optional enhanced) audio PDUs. The SIS PDUs are then processed by the SIS transport 570 to produce SIS data, the AAS PDUs are processed by the AAS transport 575 to produce AAS data, and the PSD PDUs are processed by the PSD transport 580 to produce MPS data (MPSD) and any SPS data (SPSD). The SIS data, AAS data, MPSD and SPSD are then sent to a user interface 590. The SIS data, if requested by a user, can then be displayed. Likewise, MPSD, SPSD, and any text based or graphical AAS data can be displayed. The Stream 0 and Stream 1 PDUs are processed by Layer 4, comprised of audio transport 590 and audio decoder 595. There may be up to N audio transports corresponding to the number of programs received on the IBOC waveform. Each audio transport produces encoded MPS packets or SPS packets, corresponding to each of the received programs. Layer 4 receives control information from the user interface, including commands such as to store or play programs, and to seek or scan for radio stations broadcasting hybrid IBOC signal. Layer 4 also provides status information to the user interface.

Hybrid HD radio signals include both analog and digital audio information processed by an HD radio receiver, and it is desirable to align the analog audio with the digital audio in the broadcast signal. However, alignment of the analog audio information with the digital audio information can be a challenge in digital radio systems. Radio broadcast equipment typically modulates the analog portion of the IBOC DAB waveform separately from the digital portion of the IBOC DAB waveform. There can be many reasons that can cause misalignment in broadcast equipment between the analog and the digital portions of the IBOC DAB waveform. An improved approach would be for one core piece of radio broadcast equipment to align the analog with the digital portions before generating the hybrid radio waveform.

In the example of FIG. 1, the radio broadcast equipment includes an exciter engine subsystem 58, or exgine, to modulate the digital portion of the hybrid IBOC DAB waveform, and a separate analog exciter to modulate the analog portion of the hybrid IBOC DAB waveform. The ability to modulate both the analog and digital portions of the hybrid IBOC DAB waveform with one exciter engine would allow for alignment of the analog and digital portions in the IBOC DAB broadcast signal.

Figure 7:
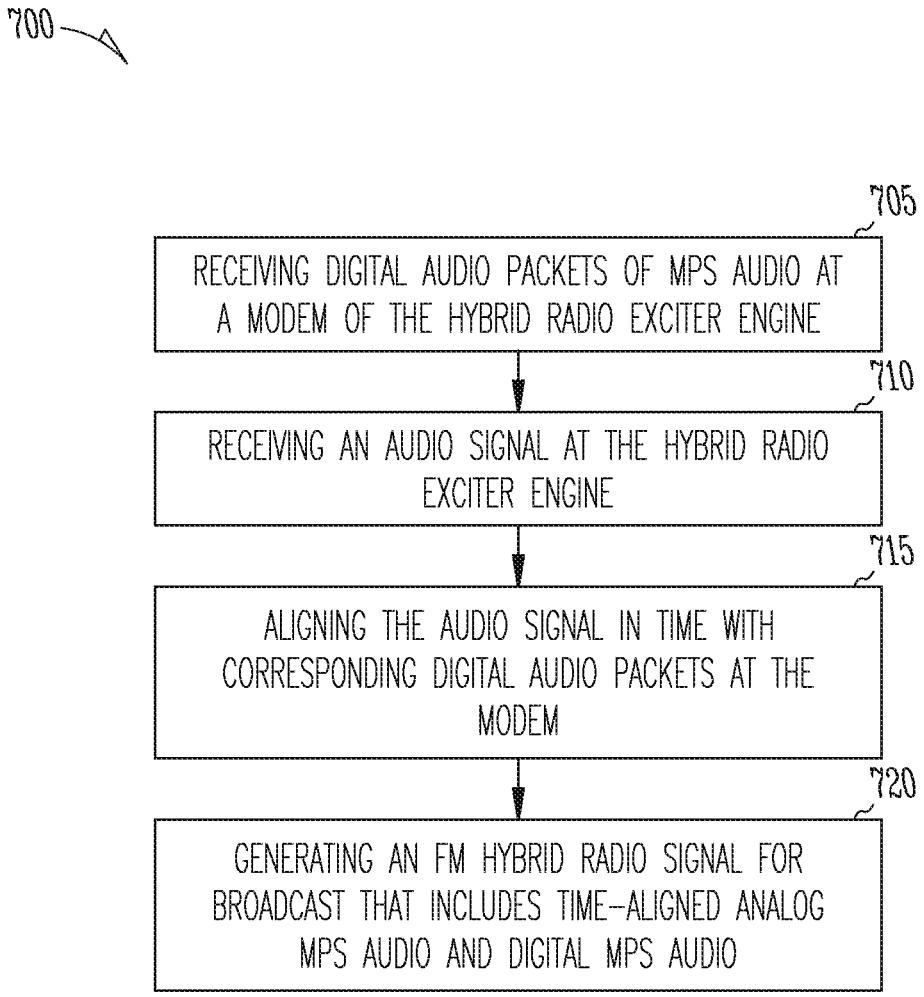
FIG. 7 is a flow diagram of a method of controlling operation of a hybrid radio exciter engine.

FIG. 7 is a flow diagram of a method 700 of controlling operation of a hybrid radio exciter engine. At 705, digital audio packets of MPS audio are received by the hybrid radio exciter engine. The hybrid radio exciter engine includes a radio modem and the digital audio packets are provided to the modem. At 710, an audio signal is received at the hybrid radio exciter engine. The audio signal is a digitized version of an analog audio signal of the MPS audio. In some embodiments, the audio signal is an audio engineer society (AES) formatted audio signal.

At 715, the audio signal is aligned in time with corresponding digital audio packets at the modem. At 720, a frequency modulated (FM) hybrid radio signal is generated for broadcast that includes time-aligned analog MPS audio and digital MPS audio. This time-aligned broadcast signal results in the digital audio and the analog audio being available at the same location without an additional alignment step being necessary.

Figure 8:
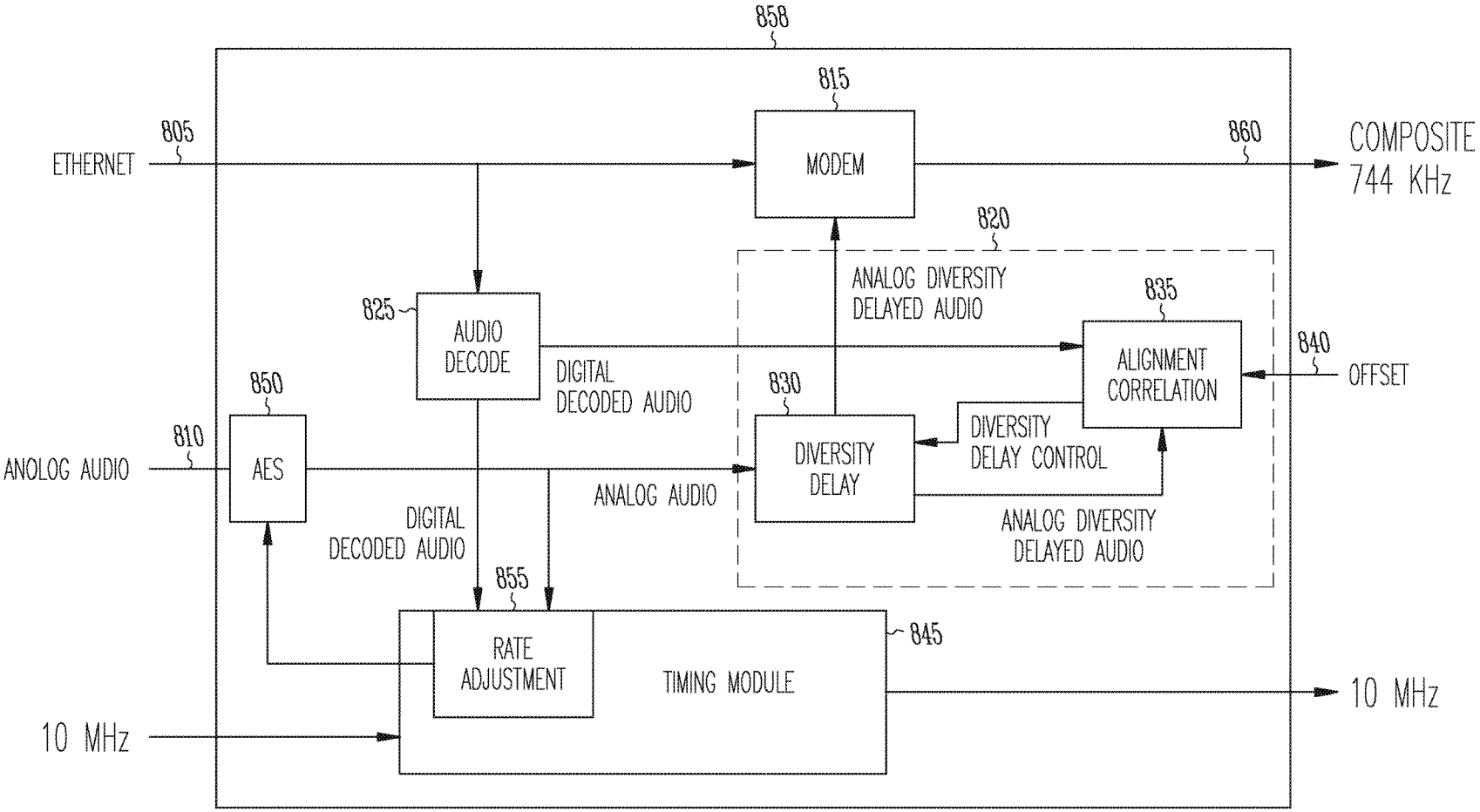
FIG. 8 is a block diagram of portions of an embodiment of a radio exciter engine subsystem.

FIG. 8 is a block diagram of portions of an embodiment of a radio exciter engine subsystem 858 for generating a frequency modulation (FM) hybrid radio signal for broadcast. The subsystem automatically aligns analog audio information with digital audio information for radio broadcast. The subsystem includes a digital input port 805 to receive digital audio packets of MPS audio. The digital input port 805 may be coupled to an Ethernet network and the digital input port 805 may be an Ethernet port. The radio exciter engine subsystem 858 also includes an analog input port 810. The analog input port may be operatively coupled to an STL of radio broadcast equipment.

It is not known how signals at the analog input align with signals at the digital input. The analog input port may receive an AES audio signal that is a digitized version of the analog signal component of the FM hybrid radio signal. In certain embodiments, the AES audio signal includes 16-bit digitized samples of the MPS analog audio signal sampled at 44.1 kilohertz. In certain embodiments, the AES audio signal is an FM composite AES audio signal that includes, for example, both the left and right channels of the MPS audio.

The radio exciter engine subsystem 858 also includes a modem 815 and an alignment unit 820. The alignment unit 820 aligns the AES audio signal in time with the digital audio packets at the radio modem.

The modem 815 generates the FM hybrid radio signal at output 860 using the digital audio packets and the time-aligned AES audio signal. In some embodiments, the modem 815 generates an FM IBOC radio signal that includes the time-aligned AES audio signal in an analog FM signal of the FM IBOC radio signal and the time-aligned digital audio in subcarriers of the FM IBOC radio signal. Because one radio exciter engine (or one exgine) is used to broadcast both the digital and the analog portions of the audio, one exgine that includes the radio exciter engine subsystem 858 of FIG. 8 can replace the digital exciter 56 of FIG. 1 that includes both an exciter engine (exgine) subsystem 58 and an analog exciter 60.

Returning to FIG. 8, the radio exciter engine subsystem 858 can include an audio decoder 825 to decode the received digital audio packets and generate a digital audio signal. The generated digital audio signal can be used to align the AES audio signal and the digital audio packets at the modem 815. The alignment unit 820 determines an offset between the digital audio signal and the AES audio signal. The alignment unit 820 can include a correlation unit 835 that performs an alignment correlation algorithm to determine the offset between audio data of the digital audio signal and digitized samples of the AES audio signal.

The alignment unit 820 includes a delay circuit 830. The delay circuit 830 delays arrival of one or more digitized samples of the AES audio signal at the radio modem according to the determined offset. In certain embodiments, the digitized samples of the AES audio signal are time-aligned with the digital audio packets at arrival to the modem. In certain embodiments, the modem 815 includes an audio sample buffer and a digital audio packet buffer. The delay circuit 830 provides delay to align the position of the digitized samples of the AES audio signal in the audio sample buffer with the corresponding digital audio packet.

The delay circuit 830 can provide a diversity delayed AES audio signal to the modem 815 and the correlation unit 835. The correlation unit 835 can use a feedback loop to align the digitized samples of the AES audio signal with the digital audio packets at the modem 815. In some embodiments, the radio exciter engine subsystem 858 is included with radio broadcasting equipment that includes an off-air radio receiver (not shown) to be run in a split mode in which one audio channel (e.g., the left audio channel) includes the digital audio in mono, and the other audio channel (e.g., the right audio channel) includes the analog audio in mono. The offset 840 between the digital and the analog audio is determined and received by the correlation unit 835 and is used to adjust the delay circuit 830 based on the offset.

The radio exciter engine subsystem 858 may also adjust a sampling rate of the analog signal to time-align the analog audio with the digital audio. The radio exciter engine subsystem 858 can include a timing module 845 and a sampling circuit 850. The timing module 845 can include one or more hardware circuits that provide clock timing signals, such as a sample clock signal to the sampling circuit 850. The sampling circuit 850 resamples the AES audio signal using a clock signal provided by the timing module 845 to produce a clock-restored AES audio signal. The alignment unit uses a sampling rate adjustment to time-align the clock-restored AES audio signal with the digital audio packets at the modem 815.

The rate adjustment by the radio exciter engine subsystem 858 relies on the difference in samples generated by the local clock-restored AES audio signal and the digital audio generated by the exporter 20 platform. This difference can be used to adjust the exgine clock so there is no rate difference between AES audio signal and the digital audio. In some embodiments, the radio exciter engine subsystem 858 includes a rate adjustment circuit 855 that changes the sampling rate of the sampling circuit 850 to reduce a sample rate difference between the clock-restored AES audio signal and the digital audio signal generated by the audio decoder 825. The result is that the analog audio information of the AES audio signal is rate-aligned and time-aligned to the digital audio information of the digital audio packets in a hybrid radio signal for broadcast.

Figure 9:
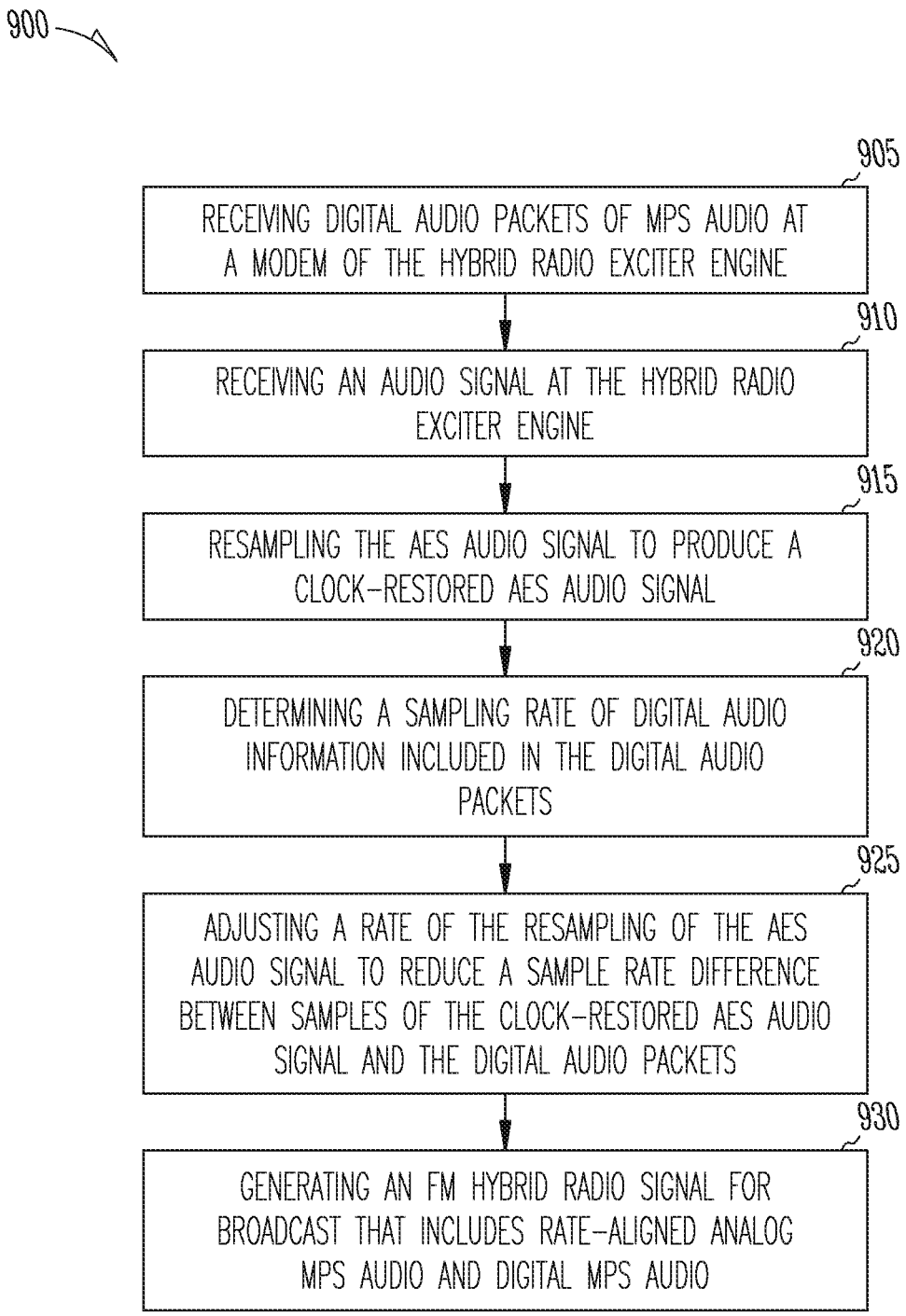
FIG. 9 is a flow diagram of another method of controlling operation of a hybrid radio exciter engine.

For completeness, FIG. 9 is a flow diagram of a method 900 of controlling operation of a hybrid radio exciter engine, or exgine, to adjust the sample rate of the AES audio signal based on the sample rate used to generate the digital audio packets. At 905, digital audio packets of MPS audio are received at a digital port of the hybrid radio exciter engine. The digital audio packets are provided to a modem of the hybrid radio exciter engine. At 910, an audio signal is received at the hybrid radio exciter engine. The audio signal is a digitized version of an analog audio signal of the MPS audio. In some embodiments, the audio signal is an AES formatted audio signal.

At 915, the AES audio signal is resampled to produce a clock-restored AES audio signal. The AES audio signal is restored to the clock of the exgine platform. At 920, a sampling rate of the digital audio information included in the digital audio packets is determined. In some embodiments, the sampling rate of the digital audio information is determined by producing a digital signal using the digital audio packets (e.g., by decoding the audio packets) and determining the sample rate of the produced signal.

At 925, the rate of the resampling of the AES audio signal is adjusted to reduce a sample rate difference between samples of the clock-restored AES audio signal and the digital audio packets. This results in rate-alignment of the analog audio information of the clock-restored AES audio signal and the digital audio information of the digital audio packets. At 930, a frequency modulated (FM) hybrid radio signal for broadcast is generated that includes rate-aligned analog MPS audio and digital MPS audio.

The methods and devices described herein place the ability to align the analog audio and digital audio of a hybrid radio signal into one radio exciter engine or exgine. This simplifies the process of assessing and managing the time-alignment and rate-synchronization of the analog audio and the digital audio of the radio broadcast.

Additional Examples and Disclosure

Example 1 includes subject matter (such as an apparatus for generating a frequency modulation (FM) hybrid radio signal for broadcast) comprising a digital input port configured to receive digital audio packets of main program service (MPS) audio, a modem operatively coupled to the digital port, an analog input port configured to receive an audio engineer society format (AES) audio signal that is a digitized version of the analog signal component of the FM hybrid radio signal, and an alignment unit. The alignment unit is configured to time-align the AES audio signal with the digital audio packets at the modem; wherein the modem is configured to generate the FM hybrid radio signal using the digital audio packets and the time-aligned AES audio signal.

In Example 2, the subject matter of Example 1 optionally includes an audio decoder configured to decode the received digital audio packets and generate a digital audio signal. The alignment unit is optionally configured to determine an offset between the digital audio signal and the AES audio signal, and includes a delay circuit configured to delay arrival of one or more digitized samples of the AES audio signal at the modem according to the determined offset.

In Example 3, the subject matter of Example 2 optionally includes an alignment unit that includes a correlation unit configured to perform an alignment correlation algorithm to determine the offset between audio data of the digital audio signal and the digitized samples of the AES audio signal.

In Example 4, the subject matter of one or any combination of Examples 1-3 optionally includes a timing module and a sampling circuit. The sampling circuit configured to resample the AES audio signal using a clock signal of the timing module to produce a clock-restored AES audio signal and the alignment unit is configured to time-align the clock-restored AES audio signal with the digital audio packets at the modem.

In Example 5, the subject matter of Example 4 optionally includes an audio decoder configured to decode the received digital audio packets and generate a digital audio signal; and a rate adjustment circuit configured to change the sampling rate of the sampling circuit to reduce a sample rate difference between the clock-restored AES audio signal and the digital audio signal.

In Example 6, the subject matter of one or any combination of Examples 1-5 optionally includes a digital port is an Ethernet port, and an analog port operatively coupled to a studio transmitter link of radio broadcast studio equipment.

In Example 7, the subject matter of one or any combination of Examples 1-6 optionally includes a modem configured to generate an FM in-band on-channel (IBOC) radio signal that includes the time-aligned AES audio signal in an analog FM signal of the FM IBOC radio signal and the time-aligned digital audio in subcarriers of the FM IBOC radio signal.

In Example 8, the subject matter of one or any combination of Examples 1-7 optionally includes an analog port configured to receive an FM composite AES audio signal.

Example 9 includes subject matter (such as a method for controlling operation a hybrid radio exciter engine, a means for performing acts, or a machine-readable medium including instructions that, when performed by the machine, cause the machine to perform acts), or can optionally be combined with the subject matter of one or any combination of Examples 1-8 to include such subject matter, comprising receiving digital audio packets of main program service (MPS) audio at a digital port of the hybrid radio exciter engine and providing the digital audio packets to a modem of the hybrid radio exciter engine, receiving an audio engineer society format (AES) audio signal of the MPS audio at an analog port of the hybrid radio exciter engine, wherein the AES audio signal is a digitized version of an analog audio signal of the MPS audio, aligning the AES audio signal in time with corresponding digital audio packets at the modem, and generating a frequency modulated (FM) hybrid radio signal for broadcast that includes time-aligned analog MPS audio and digital MPS audio.

In Example 10, the subject matter of Example 9 optionally includes decoding the digital audio packets to produce a digital audio signal, determining an offset between audio data of the digital audio signal and audio data of the AES audio signal, and delaying digitized samples of the AES audio signal modem according to the determined offset before transferring the digitized samples to the modem.

In Example 11, the subject matter of Example 10 optionally includes determining the offset between the between audio data of the digital audio signal and the audio data of the audio samples using an alignment correlation algorithm.

In Example 12, the subject matter of one or any combination of Examples 9-11 optionally includes resampling the AES audio signal to produce a clock-restored AES audio signal at hybrid radio exciter engine, and aligning the clock-restored AES audio signal in time with the digital audio packets at the modem.

In Example 13, the subject matter of one or any combination of Examples 9-12 optionally includes decoding the digital audio packets to produce a digital audio signal; and changing the sampling rate of the AES audio signal to reduce a sample rate difference between the clock-restored AES audio signal and the digital audio signal.

In Example 14, the subject matter of one or any combination of Examples 9-13 optionally includes receiving the digital audio packets of the MPS audio from an Ethernet network; and receiving an AES audio signal of MPS audio from radio broadcast studio equipment.

In Example 15, the subject matter of one or any combination of Examples 9-14 optionally includes generating an FM in-band on-channel (IBOC) radio signal that includes the time-aligned AES audio signal in an analog FM signal of the FM IBOC radio signal and the time-aligned digital audio in subcarriers of the FM IBOC radio signal.

Example 16 includes subject matter (such as an apparatus for generating a frequency modulation (FM) hybrid radio signal for broadcast), or can optionally be combined with one or any combination of Examples 1-15 to include such subject matter, comprising a digital input port configured to receive digital audio packets of main program service (MPS) audio, a modem operatively coupled to the digital input port, an analog input port configured to receive an audio engineer society format (AES) audio signal that is a digitized version of the analog signal component of the FM hybrid radio signal, a sampling circuit configured to resample the AES audio signal to produce a clock-restored AES audio signal, and a rate adjustment circuit. The rate adjustment circuit is configured to determine a sampling rate of digital audio information included in the digital audio packets and adjust a rate of resampling of the AES audio signal to reduce a sample rate difference between an audio sample of the clock-restored AES audio signal and a digital audio packet corresponding to the audio sample. The modem is configured to generate the FM hybrid radio signal using time-aligned AES audio samples and digital MPS audio.

In Example 17, the subject matter of Example 16 optionally includes an audio decoder configured to decode the received digital audio packets and generate a digital audio signal. The rate adjustment circuit is optionally configured to determine the sample rate of the digital audio information using the generated digital audio signal and reduce a difference between the sample rate of the clock-restored AES audio signal and the sample rate of the digital audio information.

In Example 18, the subject matter of one or both of Examples 16 and 17 optionally includes a digital port that is an Ethernet port, and the analog port operatively coupled to a studio transmitter link of radio broadcast studio equipment.

In Example 19, the subject matter of one or any combination of Examples 16-18 optionally includes a modem configured to generate an FM in-band on-channel (IBOC) radio signal that includes the time-aligned analog audio in an analog FM signal of the FM IBOC radio signal and the time-aligned digital audio in subcarriers of the FM IBOC radio signal.

In Example 20, the subject matter of one or any combination of Examples 16-19 optionally includes an analog port is configured to receive an FM composite AES audio signal.

These non-limiting examples can be combined in any permutation or combination. The above detailed description includes references to the accompanying drawings, which form a part of the detailed description. The drawings show, by way of illustration, specific examples of how embodiments of the invention may be practiced. It is understood that other embodiments may be utilized and structural changes may be made without departing from the scope of the claimed subject matter.

Many other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the invention described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can be typically be found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other micro-controller, or can be conventional central processing units (CPUs) having one or more processing cores, including specialized graphics processing unit (GPU)-based cores in a multi-core CPU.

The process actions or operations of a method, process, or algorithm described in connection with the embodiments disclosed herein can be embodied directly in hardware, in a software module executed by a processor, or in any combination of the two. The software module can be contained in computer-readable media that can be accessed by a computing device. The computer-readable media includes both volatile and nonvolatile media that are either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Bluray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in the RAM memory, flash memory, ROM memory, EPROM memory, EEPROM memory, registers, hard disk, a removable disk, a CD-ROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory" as used in this document means "enduring or long-lived". The phrase "non-transitory computer-readable media" includes any and all computer-readable media, with the sole exception of a transitory, propagating signal. This includes, by way of example and not limitation, non-transitory computer-readable media such as register memory, processor cache and random-access memory (RAM).

The phrase "audio signal" is a signal that is representative of a physical sound.

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the invention described herein, or portions thereof, may be stored, received, transmitted, or read from any desired combination of computer or machine readable media or storage devices and communication media in the form of computer executable instructions or other data structures.

Embodiments of the invention described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the scope of the disclosure. As will be recognized, certain embodiments of the inventions described herein can be embodied within a form that does not provide all of the features and benefits set forth herein, as some features can be used or practiced separately from others.

What is claimed is:

1. An apparatus for generating a frequency modulation (FM) hybrid radio signal for broadcast, the apparatus comprising:

a digital input port configured to receive digital audio packets of main program service (MPS) audio;

a modem operatively coupled to the digital port;

an analog input port configured to receive an audio engineer society format (AES) audio signal that is a digitized version of the analog signal component of the FM hybrid radio signal; and an alignment unit configured to time-align the AES audio signal with the digital audio packets at the modem; wherein the modem is configured to generate the FM hybrid radio signal using the digital audio packets and the time-aligned AES audio signal.

2. The apparatus of claim 1, including:

an audio decoder configured to decode the received digital audio packets and generate a digital audio signal;

wherein the alignment unit is configured to determine an offset between the digital audio signal and the AES audio signal, and includes a delay circuit configured to delay arrival of one or more digitized samples of the AES audio signal at the modem according to the determined offset.

3. The apparatus of claim 2, wherein the alignment unit includes a correlation unit configured to perform an alignment correlation algorithm to determine the offset between audio data of the digital audio signal and the digitized samples of the AES audio signal.

4. The apparatus of claim 1, including a timing module and a sampling circuit, the sampling circuit configured to resample the AES audio signal using a clock signal of the timing module to produce a clock-restored AES audio signal and the alignment unit is configured to time-align the clock-restored AES audio signal with the digital audio packets at the modem.

5. The apparatus of claim 4, including:

an audio decoder configured to decode the received digital audio packets and generate a digital audio signal; and a rate adjustment circuit configured to change the sampling rate of the sampling circuit to reduce a sample rate difference between the clock-restored AES audio signal and the digital audio signal.

6. The apparatus of claim 1, wherein the digital port is an Ethernet port, and the analog port is operatively coupled to a studio transmitter link of radio broadcast studio equipment.

7. The apparatus of claim 1, wherein the modem is configured to generate an FM in-band on-channel (IBOC) radio signal that includes the time-aligned AES audio signal in an analog FM signal of the FM IBOC radio signal and the time-aligned digital audio in subcarriers of the FM IBOC radio signal.

8. The apparatus of claim 1, wherein the AES audio signal is an FM composite AES audio signal.

9. A method for controlling operation of a hybrid radio exciter engine, the method comprising:

receiving digital audio packets of main program service (MPS) audio at a digital port of the hybrid radio exciter engine and providing the digital audio packets to a modem of the hybrid radio exciter engine;

receiving an audio engineer society format (AES) audio signal of the MPS audio at an analog port of the hybrid radio exciter engine, wherein the AES audio signal is a digitized version of an analog audio signal of the MPS audio;

aligning the AES audio signal in time with corresponding digital audio packets at the modem; and generating a frequency modulated (FM) hybrid radio signal for broadcast that includes time-aligned analog MPS audio and digital MPS audio.

10. The method of claim 9, wherein aligning the audio samples includes:

decoding the digital audio packets to produce a digital audio signal;

determining an offset between audio data of the digital audio signal and audio data of the AES audio signal; and delaying digitized samples of the AES audio signal modem according to the determined offset before transferring the digitized samples to the modem.

11. The method of claim 10, wherein determining the offset includes determining the offset between the between audio data of the digital audio signal and the audio data of the audio samples using an alignment correlation algorithm.

12. The method of claim 9, including:

resampling the AES audio signal to produce a clock-restored AES audio signal at hybrid radio exciter engine;

wherein aligning the AES audio signal includes aligning the clock-restored AES audio signal in time with the digital audio packets at the modem.

13. The method of claim 9, including:

decoding the digital audio packets to produce a digital audio signal; and changing the sampling rate of the AES audio signal to reduce a sample rate difference between the clock-restored AES audio signal and the digital audio signal.

14. The method of claim 9, wherein receiving digital audio packets includes receiving the digital audio packets of the MPS audio from an Ethernet network; and wherein receiving the AES audio signal includes receiving an AES audio signal of MPS audio from radio broadcast studio equipment.

15. The method of claim 9, wherein generating the FM hybrid radio signal includes generating an FM in-band on-channel (IBOC) radio signal that includes the time-aligned AES audio signal in an analog FM signal of the FM IBOC radio signal and the time-aligned digital audio in subcarriers of the FM IBOC radio signal.

16. An apparatus for generating a frequency modulation (FM) hybrid radio signal for broadcast, the apparatus comprising:

a digital input port configured to receive digital audio packets of main program service (MPS) audio;

a modem operatively coupled to the digital input port;

an analog input port configured to receive an audio engineer society format (AES) audio signal that is a digitized version of the analog signal component of the FM hybrid radio signal;

a sampling circuit configured to resample the AES audio signal to produce a clock-restored AES audio signal; and a rate adjustment circuit configured to determine a sampling rate of digital audio information included in the digital audio packets and adjust a rate of resampling of the AES audio signal to reduce a sample rate difference between an audio sample of the clock-restored AES audio signal and a digital audio packet corresponding to the audio sample;

wherein the modem is configured to generate the FM hybrid radio signal using time-aligned AES audio samples and digital MPS audio.

17. The apparatus of claim 16, including:

an audio decoder configured to decode the received digital audio packets and generate a digital audio signal;

wherein the rate adjustment circuit is configured to determine the sample rate of the digital audio information using the generated digital audio signal and reduce a difference between the sample rate of the clock-restored AES audio signal and the sample rate of the digital audio information.

18. The apparatus of claim 16, wherein the digital port is an Ethernet port, and the analog port is operatively coupled to a studio transmitter link of radio broadcast studio equipment.

19. The apparatus of claim 16, wherein the modem is configured to generate an FM in-band on-channel (IBOC) radio signal that includes the time-aligned analog audio in an analog FM signal of the FM IBOC radio signal and the time-aligned digital audio in subcarriers of the FM IBOC radio signal.

20. The apparatus of claim 16, wherein the analog port is configured to receive an FM composite AES audio signal.

* * * * *